US007765812B2

(12) United States Patent
Chang et al.

(10) Patent No.: US 7,765,812 B2
(45) Date of Patent: Aug. 3, 2010

(54) SYSTEM FOR DETECTING MIS-CONNECTED STATE BETWEEN COMMUNICATION LINES FOR MULTI-TYPE AIR CONDITIONER AND METHOD THEREOF

(75) Inventors: Se-Dong Chang, Gyeonggi-Do (KR); Kwang-Woon Kim, Seoul (KR); Yoon-Been Lee, Seoul (KR); Hyung-Soo Kim, Seoul (KR); Sung-Hwan Kim, Seoul (KR); Jeong-Eon Oh, Seoul (KR); Jae-Heuk Choi, Seoul (KR); Song Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 982 days.

(21) Appl. No.: 11/258,126

(22) Filed: Oct. 26, 2005

(65) Prior Publication Data

US 2006/0086104 A1 Apr. 27, 2006

(30) Foreign Application Priority Data

Oct. 26, 2004 (KR) ..... 10-2004-0085918

(51) Int. Cl.
*F25B 41/04* (2006.01)

(52) U.S. Cl. ..... 62/115; 62/129; 62/212; 62/225

(58) Field of Classification Search ..... 62/129, 62/212, 222, 224, 225, 210
See application file for complete search history.

(56) References Cited

U.S. PATENT DOCUMENTS 4,527,399 A * 7/1985 Lord ..... 62/212
2002/0002834 A1* 1/2002 Kuroki et al. ..... 62/238.6
2004/0016241 A1 1/2004 Street et al.
2004/0020223 A1* 2/2004 Doi et al. ..... 62/225

FOREIGN PATENT DOCUMENTS

| | | | |
|---|---|---|---|
| EA | 1 150 074 | A2 | 10/2001 |
| EA | 1 150 074 | A3 | 10/2001 |
| EP | 0 783 091 | A1 | 7/1997 |
| EP | 1 300 787 | A1 | 4/2003 |
| JP | 08-121850 | A | 5/1996 |
| KR | 10-2001-0048364 | A | 6/2001 |

* cited by examiner

*Primary Examiner*—William E Tapolcai
(74) *Attorney, Agent, or Firm*—Birch, Stewart, Kolasch & Birch, LLP

(57) ABSTRACT

A system for detecting a mis-connected state between communication lines for a multi-type air conditioner and a method thereof. The system comprises an indoor unit pipe temperature detection unit for detecting a temperature of an indoor unit pipe, and a microprocessor for controlling an opening of an electronic expansion valve based on a temperature detected by the indoor unit pipe temperature detection unit, comparing a temperature response characteristic of the indoor unit pipe with a preset temperature response characteristic of a normal indoor unit pipe based on an opening of the electronic expansion valve, and thereby judging whether the communication lines are mis-connected to one another or not. An indoor unit from which the mis-connection has been generated is fast detected, and error information is displayed. Accordingly, the mis-connected state between the communication lines is restored, thereby preventing a damage of the system due to the mis-connection.

19 Claims, 5 Drawing Sheets

SYSTEM FOR DETECTING MIS-CONNECTED STATE BETWEEN COMMUNICATION LINES FOR MULTI-TYPE AIR CONDITIONER AND METHOD THEREOF

BACKGROUND OF THE INVENTION

1. Field of the Invention

The present invention relates to a multi-type air conditioner, and more particularly, to a system for detecting a mis-connected state between communication lines for a multi-type air conditioner capable of preventing a damage of the system by judging a mis-connected state between communication lines based on a temperature response characteristic of an indoor unit refrigerant pipe according to an opening of an electronic expansion valve, and a method thereof.

2. Description of the Background Art

Generally, an air conditioner serves to control a temperature, a humidity, air stream, and a clean degree for a comfortable indoor circumstance. The air conditioner is classified into an integral-type air conditioner and a separated-type air conditioner according to a unit construction. The integral-type air conditioner is constructed as an indoor unit and an outdoor unit are received in a single case. On the contrary, the separated-type air conditioner is constructed as an outdoor unit constituted with a compressor and a condenser is separated from an indoor unit constituted with an evaporator. Additionally, there is an air conditioner for cooling and heating capable of selectively performing a cooling operation and a heating operation by switching a flow path of a refrigerant by a flow path switching valve provided at the air conditioner. Recently, a multi-type air conditioner having a plurality of indoor units for cooling or heating each space of an indoor room is being increased. The multi-type air conditioner is constructed as a plurality of outdoor units each having a plurality of compressors corresponding to a load of the indoor unit are connected to one another in parallel.

FIG. 1 is an exemplary view showing an outdoor unit of a multi-type air conditioner in accordance with the background art.

As shown, the multi-type air conditioner comprises a plurality of outdoor units (11*a*~11*n*), and a plurality of indoor units (not shown).

Each outdoor unit 11*a*~11*n* comprises a first compressor 13*a* and a second compressor 13*b* constructed as one pair, a four-way valve 21 for switching a flow path of a refrigerant, an outdoor heat exchanger 25 for heat-exchanging a refrigerant, and a common accumulator 27 for providing a gaseous refrigerant to the first compressor 13*a* and the second compressor 13*b*.

A discharge pipe 15 for discharging a refrigerant is provided at each upper region of the first compressor 13*a* and the second compressor 13*b*. Also, a suction pipe 17 connected to the common accumulator 27 for sucking a refrigerant is provided at each lower region of the first compressor 13*a* and the second compressor 13*b*. An oil balancing pipe 19 for flowing oil with balance is connected between the first compressor 13*a* and the second compressor 13*b*.

Each compressor is provided with an oil separator 31 and a check valve 33 at the discharge side thereof. Also, each separator 31 is provided with an oil returning path 35 for returning oil to the suction side of each compressor.

Each check valve 33 is provided with a four-way valve 21 for switching a flow path of a refrigerant at a lower side thereof. One port of the four-way valve 21 is connected to the outdoor heat exchanger 25, another port thereof is connected to the common accumulator 27, and the other port thereof is connected to a connection pipe 41 connected to the indoor unit.

The outdoor heat exchanger 25 is provided with a receiver 37 at one side thereof along a flow direction of a refrigerant. The receiver 37 and the connection pipe 41 are respectively provided with a service valve 43*a* and a service valve 43*b* at one side thereof. Each one side of the service valves 43*a* and 43*b* is connected to a main refrigerant pipe 45 for connecting the outdoor units 11*a*~11*n* one another.

FIG. 2 is an exemplary view showing a multi-type air conditioner having an arbitrary outdoor unit and a plurality of indoor units connected to the outdoor unit in accordance with the background art.

As shown, the multi-type air conditioner comprises an outdoor unit and a plurality of indoor units connected to the outdoor unit. The outdoor unit is connected to the plural indoor units by communication lines, thereby controlling an air conditioning of the plural indoor units.

In case that the multi-type air conditioner is installed in the same building, a plurality of outdoor units can be connected to a plurality of indoor units by communication lines crossed to one another. Accordingly, a mis-connection between the communication lines may occur.

FIG. 3 is an exemplary view showing a mis-connected state between communication lines in a multi-type air conditioner in accordance with the background art.

As shown, an indoor unit 1 receives a refrigerant from an outdoor unit A, and receives an operation control command from an outdoor unit B. Also, an indoor unit 4 receives a refrigerant from the outdoor unit B, and receives an operation control command from the outdoor unit A. Accordingly, if a mis-connection between the communication lines of the outdoor units occurs due to a cross connection therebetween, a control signal of one outdoor unit is transmitted to an indoor unit controlled by another outdoor unit. Therefore, the system is stopped while being operated thus to cause the user's inconvenience and to cause the system to be mechanically damaged.

BRIEF DESCRIPTION OF THE INVENTION

Therefore, an object of the present invention is to provide a system for detecting a mis-connected state between communication lines of a multi-type air conditioner capable of preventing a damage of the system by judging a mis-connected state between communication lines based on a temperature response characteristic of an indoor unit pipe according to an opening of an electronic expansion valve, and a method thereof.

To achieve these and other advantages and in accordance with the purpose of the present invention, as embodied and broadly described herein, there is provided a system for detecting a mis-connected state between communication lines of a multi-type air conditioner, comprising: an indoor unit pipe temperature detection unit for detecting a temperature of an indoor unit pipe; and a microprocessor for controlling an opening of an electronic expansion valve based on a temperature detected by the indoor unit pipe temperature detection unit, comparing a temperature response characteristic of the indoor unit pipe with a preset temperature response characteristic of a normal indoor unit pipe according to an opening of the electronic expansion valve, and thereby judging whether or not the communication lines are mis-connected to one another.

To achieve these and other advantages and in accordance with the purpose of the present invention, as embodied and broadly described herein, there is also provided a method for detecting a mis-connected state between communication lines of a multi-type air conditioner, comprising: operating an arbitrary outdoor unit and plural indoor units connected to the outdoor unit; detecting a temperature response characteristic of an indoor unit pipe according to an opening of an electronic expansion valve; judging whether the detected response characteristic is consistent with a preset response characteristic; if so, displaying a normally-connected state between the communication lines and performing a normal operation; if the detected response characteristic is not consistent with a preset response characteristic, stopping the system and displaying error information indicating a mis-connected state between the communication lines on an additional display unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 6 is a flowchart showing a method for detecting a mis-connected state between the communication lines for a multi-type air conditioner according to the present invention.

DETAILED DESCRIPTION OF THE INVENTION

Reference will now be made in detail to the preferred embodiments of the present invention, examples of which are illustrated in the accompanying drawings.

Figure 1:
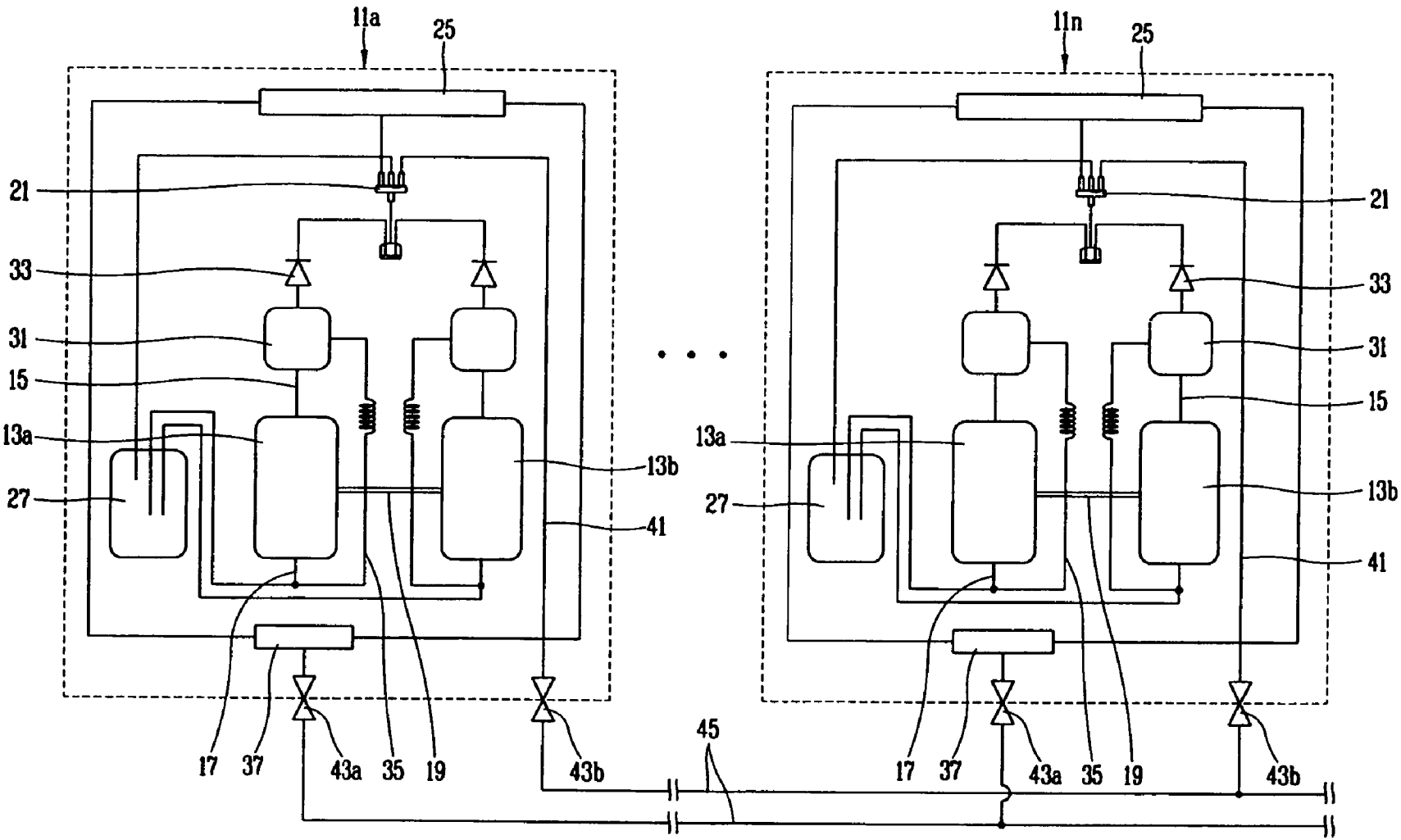
FIG. 1 BACKGROUND ART
FIG. 1 is an exemplary view showing an outdoor unit of a multi-type air conditioner in accordance with the background art.
Figure 2:
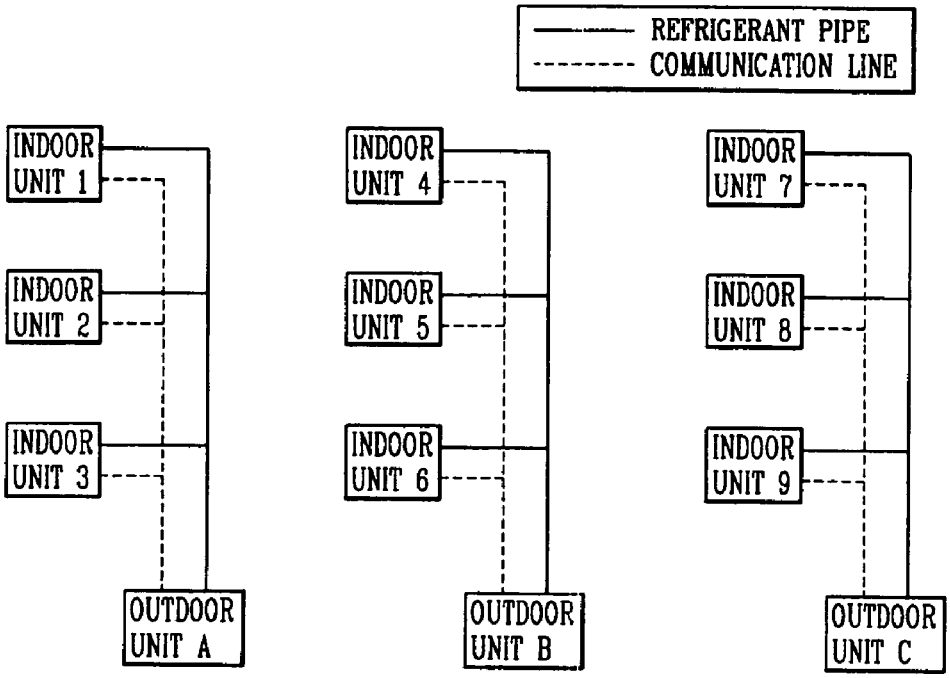
FIG. 2 BACKGROUND ART
FIG. 2 is an exemplary view showing the multi-type air conditioner having an arbitrary outdoor unit and a plurality of indoor units connected to the outdoor unit in accordance with the background art.
Figure 3:
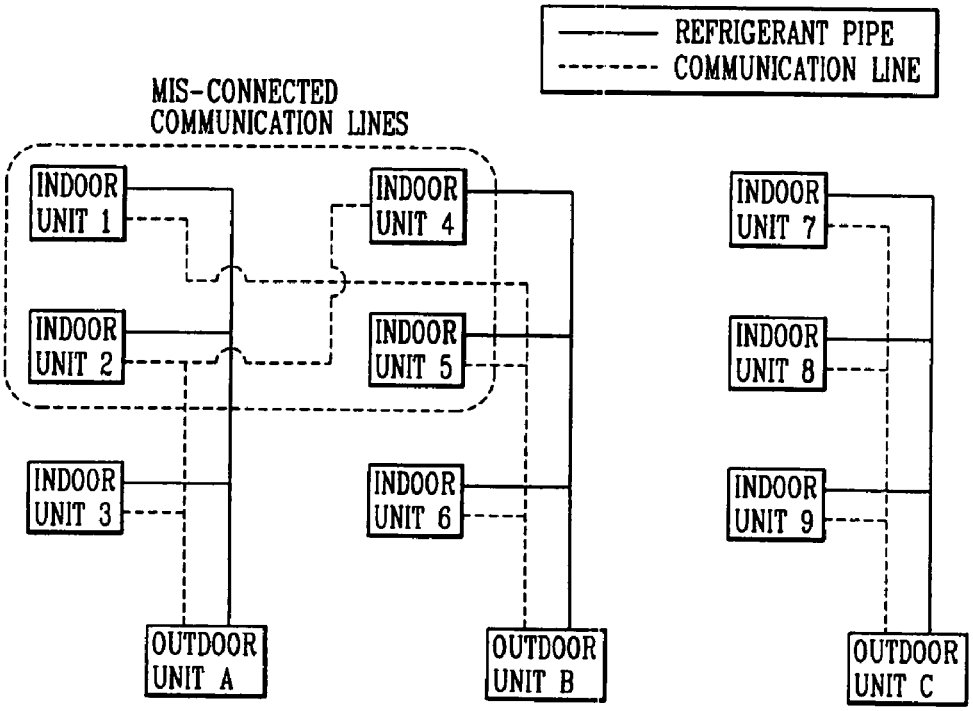
FIG. 3 BACKGROUND ART
FIG. 3 is an exemplary view showing a mis-connected state between communication lines in the multi-type air conditioner in accordance with the background art.
Figure 4:
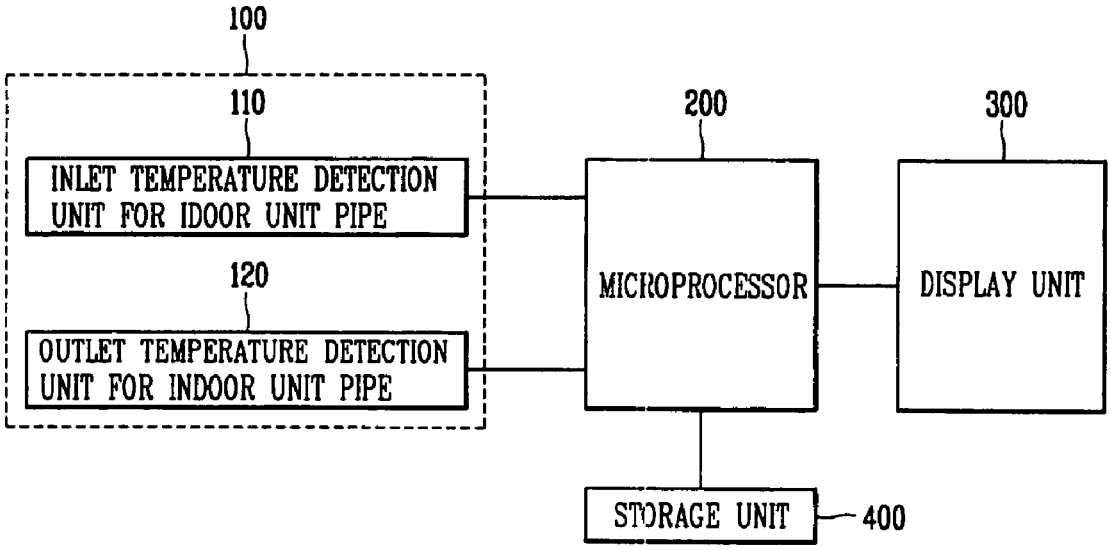
FIG. 4 is an exemplary view showing a construction of a system for detecting a mis-connected state between communication lines for a multi-type air conditioner according to the present invention.

FIG. 4 is an exemplary view showing a construction of a system for detecting a mis-connected state between communication lines for a multi-type air conditioner according to the present invention.

As shown, the system for detecting a mis-connected state between communication lines of a multi-type air conditioner according to the present invention, comprises an indoor unit pipe temperature detection unit 100 for detecting a temperature of an indoor unit refrigerant pipe (will be referred to as 'indoor unit pipe'), a microprocessor 200 for controlling an opening of an electronic expansion valve based on a temperature detected by the indoor unit pipe temperature detection unit 100, comparing a temperature response characteristic of the indoor unit pipe with a preset temperature response characteristic of a normal indoor unit pipe according to an opening of the electronic expansion valve, and thereby judging whether communication lines are mis-connected to one another or not, a display unit 400 for outputting error information indicating a mis-connected state between the communication lines, and a storage unit 300 for storing the preset temperature response characteristic of the normal indoor unit pipe. The indoor unit pipe temperature detection unit 100 comprises an inlet temperature detection unit for an indoor unit pipe 110, and an outlet temperature detection unit for an indoor unit pipe 120. As the display unit 400, a screen, a display lamp, or a buzzer for indicating a mis-connected state of the communication lines to a user may be used.

An operation of the system for detecting a mis-connected state between communication lines of a multi-type air conditioner according to the present invention will be explained.

In the present invention, a throttling degree and a flow amount of a working fluid are changed, and thereby a pipe temperature is also changed. When the communication lines are mis-connected to one another, an outdoor unit for receiving a working fluid and an outdoor unit for receiving a control command are not consistent with each other. Accordingly, a temperature response characteristic of an abnormal pipe is different from that of a normal pipe according to an opening of an electronic expansion valve. By comparing the temperature response characteristic of the normal pipe with the temperature response characteristic of the abnormal pipe, a mis-connected state between the communication lines can be detected.

More specifically, when the multi-type air conditioner is initially driven, an opening of the electronic expansion valve is controlled based on a temperature of the indoor unit pipe detected by the indoor unit pipe temperature detection unit 100. Then, a temperature response characteristic of the indoor unit pipe is compared with a preset temperature response characteristic of a normal indoor unit pipe according to an opening of the electronic expansion valve. Then, the microprocessor 200 judges whether the temperature response characteristic of the indoor unit pipe is consistent with the preset temperature response characteristic of a normal indoor unit pipe according to an opening of the electronic expansion valve for a preset time. If so, the microprocessor 200 displays a normally-connected state between the communication lines and performs a normal operation. On the contrary, if the detected response characteristic is not consistent with the preset response characteristic, the system is stopped and error information indicating a mis-connected state between the communication lines is displayed on an additional display unit.

Figure 5A:
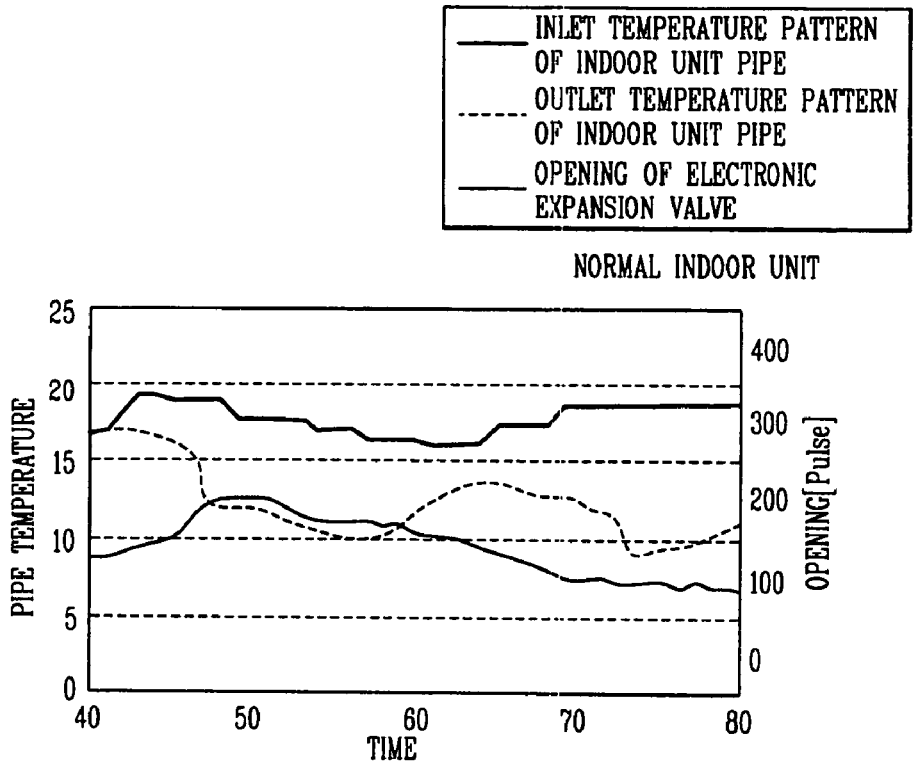
FIGS. 5A, 5B and 6 are exemplary views respectively showing a response characteristic when the communication lines are normally connected to one another and a response characteristic when the communication lines are mis-connected to one another based on an indoor unit pipe temperature when the multi-type air conditioner is operated according to the present invention.
Figure 5B:
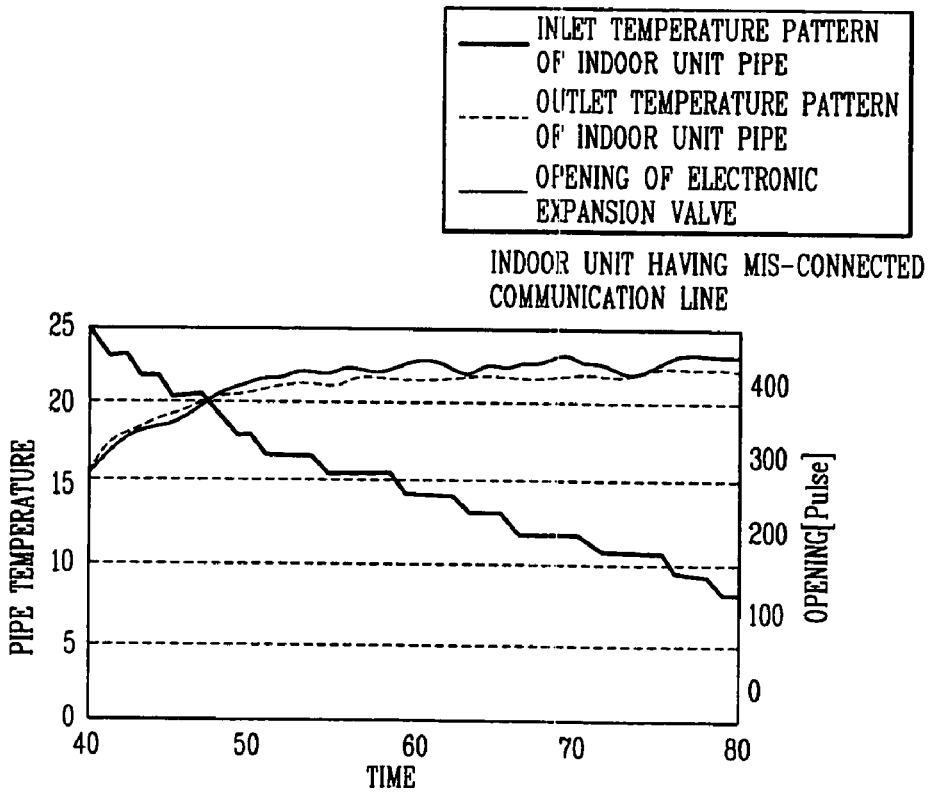

FIGS. 5A and 5B are exemplary views respectively showing a temperature response characteristic of the indoor unit pipe when the communication lines are normally connected to one another, and a temperature response characteristic of the indoor unit pipe when the communication lines are mis-connected to one another under a state that the multi-type air conditioner is operated according to the present invention.

As shown in FIGS. 5A and 5B, the response characteristic of the present invention can be variously implemented by using the microprocessor 200. That is, the response characteristic includes an inlet temperature of an indoor unit pipe, an outlet temperature of the indoor unit pipe, an inlet temperature pattern of the indoor unit pipe, an outlet temperature pattern of the indoor unit pipe, a superheating obtained by deducting the inlet temperature of the indoor unit pipe from the outlet temperature of the indoor unit pipe, or a superheating pattern. A preset response characteristic according to an opening of the electronic expansion valve when the system is in a normal state is stored in the storage unit 300.

For instance, when the communication lines are mis-connected to one another, the response characteristic has an inlet temperature pattern of the indoor unit pipe shown in FIG. 5B. On the contrary, when the communication lines are normally connected to one another, the response characteristic has an inlet temperature pattern of the indoor unit pipe shown in FIG. 5A, and the superheating has a certain pattern. Therefore, the microprocessor 200 compares a temperature response characteristic of the indoor unit pipe with a preset temperature response characteristic of the indoor unit pipe, thereby judging whether the communication lines are mis-connected to one another or not.

A method for judging a mis-connected state between communication lines of a multi-type air conditioner by the microprocessor 200 according to the present invention will be explained.

1) A mis-connected state between the communication lines can be judged by using a superheating, that is a difference value between an outlet temperature of the indoor unit pipe detected by the indoor unit pipe outlet temperature detection unit and an inlet temperature of the indoor unit pipe detected by the indoor unit pipe inlet temperature detection unit. That is, the superheating is calculated based on the inlet temperature of the indoor unit pipe and the outlet temperature of the indoor unit pipe. Then, the calculated superheating is compared with a preset superheating, thereby judging whether the communication lines are mis-connected to one another or not.

2) The detected inlet temperature of the indoor unit pipe and the detected outlet temperature of the indoor unit pipe are respectively compared with the preset inlet temperature of the indoor unit pipe and the preset outlet temperature of the indoor unit pipe.

3) A superheating, that is, a difference value between the detected inlet temperature of the indoor unit pipe and the detected outlet temperature of the indoor unit pipe is calculated. Then, the calculated superheating is compared with a preset superheating. Also, a pattern of the detected inlet temperature of the indoor unit pipe is compared with a preset pattern of the inlet temperature of the indoor unit pipe.

4) A temperature pattern of the indoor unit pipe detected for a certain time is compared with a preset temperature pattern of the normal indoor unit pipe.

5) The detected temperature pattern of the indoor unit pipe is compared with a preset inlet temperature pattern of the normal indoor unit pipe. Then, if the two temperature patterns are not consistent to each other, the microprocessor controls error information indicating a mis-connected state between the communication lines to be displayed.

6) A superheating, that is, a difference value between the detected inlet temperature of the indoor unit pipe and the detected outlet temperature of the indoor unit pipe is calculated. Then, the calculated superheating pattern is compared with a preset superheating pattern. If the two superheating patterns are not consistent to each other, the microprocessor controls error information indicating a mis-connected state between the communication lines to be displayed.

7) A superheating, that is, a difference value between the detected inlet temperature of the indoor unit pipe and the detected outlet temperature of the indoor unit pipe is calculated. Then, the calculated superheating pattern is compared with a preset superheating pattern. Also, the detected temperature pattern of the indoor unit pipe is compared with a preset temperature pattern of the indoor unit pipe. Then, if the two temperature patterns are not consistent to each other, the microprocessor controls error information indicating a mis-connected state between the communication lines to be displayed.

Figure 6:
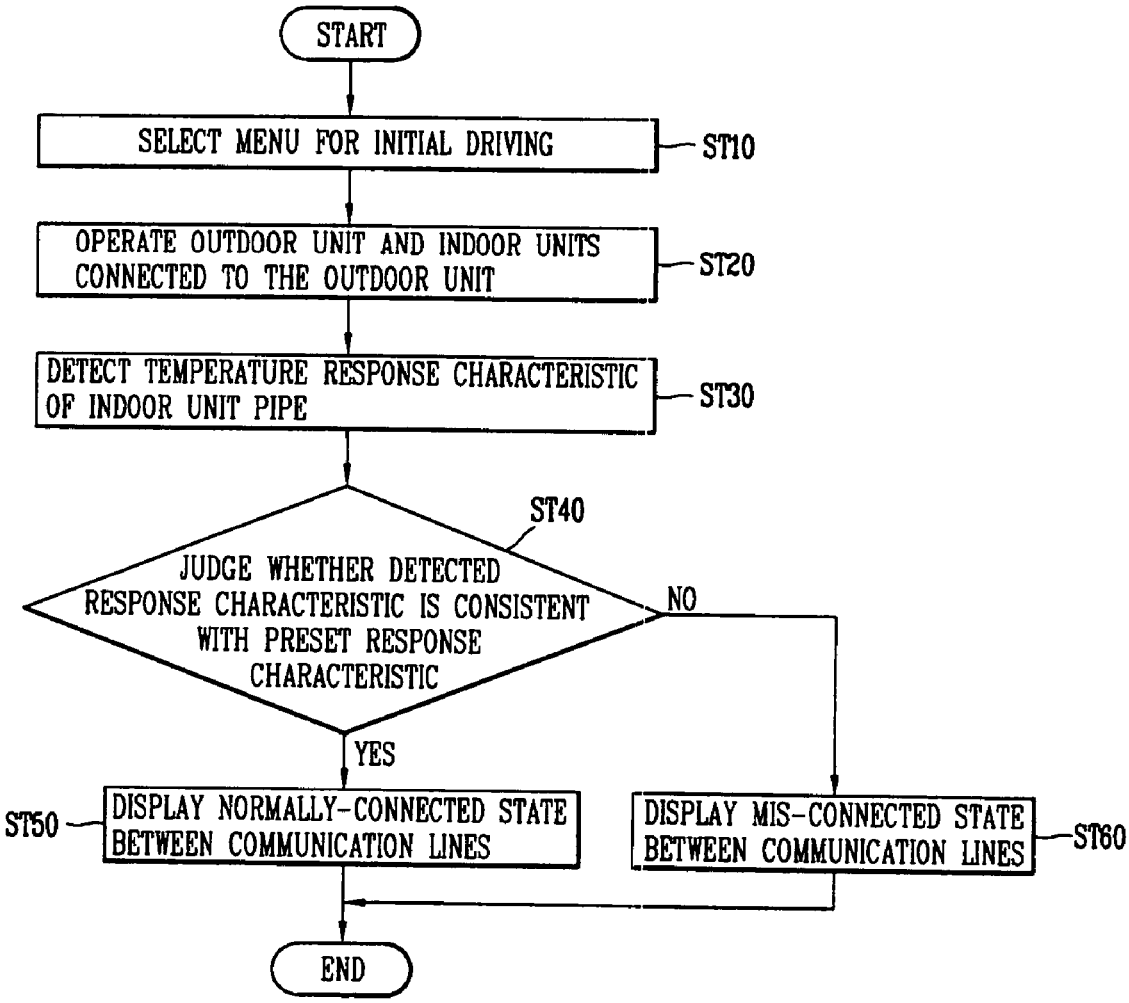

FIG. 6 is a flowchart showing a method for detecting a mis-connected state between the communication lines for a multi-type air conditioner according to the present invention.

As shown, in the multi-type air conditioner having an arbitrary outdoor unit and a plurality of indoor units connected to the outdoor unit according to the present invention, a method for detecting a mis-connected state between the communication lines of the multi-type air conditioner will be explained.

First, a user operates the arbitrary outdoor unit and the plural indoor units connected to the outdoor unit by selecting a menu for initially driving the system (ST10, ST20).

Then, the microprocessor 200 controls an opening of the electronic expansion valve based on an indoor unit pipe temperature detected by the indoor unit pipe temperature detection unit, and then detects a temperature response characteristic of the indoor unit pipe according to the opening of the electronic expansion valve (ST30). Prior to performing the initial driving, a temperature response characteristic of a normal indoor unit pipe is preset by an experiment to be stored in the storage unit 300. The response characteristic can be variously derived by the microprocessor 200. For instance, the response characteristic includes an inlet temperature of the indoor unit pipe, an outlet temperature of the indoor unit pipe, an inlet temperature pattern of the indoor unit pipe, an outlet temperature pattern of the indoor unit pipe, a superheating obtained by deducting the indoor unit pipe inlet temperature from the indoor unit pipe outlet temperature, or a superheating pattern.

Then, the microprocessor 200 compares the detected response characteristic with the preset response characteristic, thereby judging whether the two response characteristics are consistent with each other or a difference value therebetween is generated (ST40). The step of judging can be performed by the aforementioned methods 1 to 7.

Finally, when the detected response characteristic is consistent with the preset response characteristic, the microprocessor 200 displays a normal state on the display unit 400 and performs a normal operation (ST50). On the contrary, when the detected response characteristic is not consistent with the preset response characteristic or a difference value therebetween is more than a certain value, the microprocessor 200 controls the system to be stopped and displays error information indicating a mis-connected state between the communication lines on the display unit 400 (ST60).

As aforementioned, in the present invention, the temperature response characteristic of the indoor unit pipe according to the opening of the electronic expansion valve is compared with the temperature response characteristic of the indoor unit pipe. If a difference value more than a certain value is generated between the two response characteristics, it is judges that the communication lines are mis-connected to one another. Then, an indoor unit from which the mis-connection has been generated is fast detected, and error information is displayed. Accordingly, the mis-connected state between the communication lines is restored, thereby preventing a damage of the system due to the mis-connection.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A system for detecting a mis-connected state between communication lines of a multi-type air conditioner, comprising:

an indoor unit pipe temperature detection unit for detecting a temperature of an indoor unit pipe, the indoor unit pipe temperature detection unit including:

an inlet temperature detection unit for the indoor unit pipe for detecting an inlet temperature of the indoor unit pipe; and an outlet temperature detection unit for the indoor unit pipe for detecting an outlet temperature of the indoor unit pipe;

a microprocessor for controlling an opening of an electronic expansion valve based on a temperature detected by the indoor unit pipe temperature detection unit, comparing a temperature response characteristic of the indoor unit pipe with a preset temperature response characteristic of a normal indoor unit pipe based on the opening of the electronic expansion valve, and thereby judging whether communication lines are mis-connected to one another;

a display unit for outputting error information indicating a mis-connected state between the communication lines; and a storage unit for storing a preset temperature response characteristic of the indoor unit pipe according to an opening of the electronic expansion valve.

2. The system of claim 1, wherein the microprocessor calculates a superheating based on the detected inlet temperature of the indoor unit pipe and the detected outlet temperature of the indoor unit pipe, and compares the calculated superheating with a preset superheating thereby to judge whether the communication lines are mis-connected to one another.

3. The system of claim 2, wherein the superheating is a difference value between an outlet temperature of the indoor unit pipe detected by the indoor unit pipe outlet temperature detection unit and an inlet temperature of the indoor unit pipe detected by the indoor unit pipe inlet temperature detection unit.

4. The system of claim 1, wherein the microprocessor compares the temperature pattern of the indoor unit pipe detected for a preset time with a preset temperature pattern of the indoor unit pipe, thus to judge whether the communication lines are mis-connected to one another.

5. The system of claim 4, wherein if the detected temperature pattern of the indoor unit pipe is not consistent with a preset inlet temperature pattern of the indoor unit pipe, the microprocessor displays error information indicating a mis-connected state between the communication lines.

6. The system of claim 1, wherein the microprocessor calculates a superheating, that is, a difference value between the detected inlet temperature of the indoor unit pipe and the detected outlet temperature of the indoor unit pipe, compares the calculated superheating with a preset superheating, compares the detected temperature pattern of the indoor unit pipe with a preset temperature pattern of the indoor unit pipe, and if the two temperature patterns are not consistent with each other, displays error information indicating a mis-connected state between the communication lines.

7. The system of claim 1, wherein the display unit includes a screen, a display lamp and a buzzer.

8. The system of claim 1, wherein the response characteristic stored in the storage unit includes an inlet temperature of the indoor unit pipe, an inlet temperature pattern of the indoor unit pipe, an outlet temperature of the indoor unit pipe, an outlet temperature pattern of the indoor unit pipe, or a superheating pattern.

9. A method for detecting a mis-connected state between communication lines of a multi-type air conditioner, comprising:

storing a temperature response characteristic of a normal indoor unit pipe which is preset;

operating an arbitrary outdoor unit and plural indoor units connected to the outdoor unit;

detecting a temperature response characteristic of an indoor unit pipe according to an opening of an electronic expansion valve;

judging whether the detected response characteristic is consistent with a preset response characteristic;

if so, displaying a normally-connected state between communication lines and performing a normal operation;

if the detected response characteristic is not consistent with the preset response characteristic, stopping the system and displaying error information indicating a mis-connected state of the communication lines on an additional display unit, wherein the response characteristic includes an inlet temperature of the indoor unit pipe, an inlet temperature pattern of the indoor unit pipe, an outlet temperature of the indoor unit pipe, an outlet temperature pattern of the indoor unit pipe, a superheating obtained by deducting the indoor unit pipe inlet temperature from the indoor unit pipe outlet temperature, or a superheating pattern.

10. The method of claim 9, wherein in the step of judging whether the detected response characteristic is consistent with a preset response characteristic, a superheating is calculated based on the inlet temperature of the indoor unit pipe and the outlet temperature of the indoor unit pipe, and the calculated superheating is compared with the preset superheating.

11. The method of claim 9, wherein in the step of judging whether the detected response characteristic is consistent with a preset response characteristic, the inlet temperature of the indoor unit pipe is compared with a preset inlet temperature of the indoor unit pipe, and the outlet temperature of the indoor unit pipe is compared with a preset outlet temperature of the indoor unit pipe.

12. The method of claim 9, wherein in the step of judging whether the detected response characteristic is consistent with a preset response characteristic, a superheating is calculated, the calculated superheating is compared with a preset superheating, and the detected inlet temperature pattern of the indoor unit pipe is compared with a preset inlet temperature pattern of the indoor unit pipe.

13. The method of claim 9, wherein in the step of judging whether the detected response characteristic is consistent with a preset response characteristic, a temperature pattern of the indoor unit pipe detected for a certain time is compared with a preset temperature pattern of the indoor unit pipe.

14. The method of claim 9, wherein in the step of judging whether the detected response characteristic is consistent with a preset response characteristic, the temperature pattern of the indoor unit pipe detected for a certain time is compared with a preset inlet temperature pattern of the indoor unit pipe.

15. The method of claim 9, wherein in the step of judging whether the detected response characteristic is consistent with a preset response characteristic, a superheating is calculated and the calculated superheating is compared with a preset superheating.

16. The method of claim 9, wherein in the step of judging whether the detected response characteristic is consistent with a preset response characteristic, a superheating is calculated, the calculated superheating is compared with a preset superheating, and the detected inlet temperature pattern of the indoor unit pipe is compared with a preset inlet temperature pattern of the indoor unit pipe.

17. The system of claim 1, wherein the communication lines connect an outdoor unit to a plurality of indoor units, each communication line extending from the outdoor unit to an indoor unit without being connected to another indoor unit.

18. The method of claim 9, further comprising connecting the communication lines between the outdoor unit and the plurality of indoor units so that each communication line connects the outdoor unit to an indoor unit without being connected to another indoor unit.

19. A system for detecting a mis-connected state between communication lines of a multi-type air conditioner, comprising:

an indoor unit pipe temperature detector configured to detect a temperature of an indoor unit pipe, the indoor unit pipe temperature detector including:

an inlet temperature detector for the indoor unit pipe configured to detect an inlet temperature of the indoor unit pipe; and an outlet temperature detector for the indoor unit pipe configured to detect an outlet temperature of the indoor unit pipe;

a microprocessor configured to control an opening of an electronic expansion valve based on a temperature detected by the indoor unit pipe temperature detector, compare a temperature response characteristic of the indoor unit pipe with a preset temperature response characteristic of a normal indoor unit pipe based on the opening of the electronic expansion valve, and thereby judge whether communication lines are mis-connected to one another;

a display unit configured to output error information indicating a mis-connected state between the communication lines; and a storage unit configured to store a preset temperature response characteristic of the indoor unit pipe according to an opening of the electronic expansion valve.

* * * * *